United States Patent [19]

Maki

[11] 3,985,229

[45] Oct. 12, 1976

[54] DETACHABLY INTERLINKED REINFORCED TUBULAR GOLF CLUB PROTECTORS

[75] Inventor: Isao Maki, Taira, Japan

[73] Assignee: Takiron Co., Ltd., Osaka, Japan

[22] Filed: Jan. 21, 1976

[21] Appl. No.: 651,017

Related U.S. Application Data

[63] Continuation-in-part of Ser. No. 407,759, Oct. 18, 1973, abandoned.

[30] Foreign Application Priority Data

Oct. 19, 1972 Japan ..... 47-120103[U]
Feb. 28, 1973 Japan ..... 48-24670[U]

[52] U.S. Cl. ..... 206/315 R; 150/1.5 R; 220/23.4

[51] Int. Cl.[2] ..... A63D 57/00

[58] Field of Search ..... 206/315; 220/23.4, 23.6, 220/23.2, DIG. 19, 73; 150/1.5 R, 1.5 B

[56] References Cited

UNITED STATES PATENTS

| | | | |
|---|---|---|---|
| 331,023 | 11/1885 | Barrett | 220/DIG. 19 |
| 2,551,780 | 5/1951 | Wood | 206/315 |
| 2,595,987 | 5/1952 | Shears | 150/1.5 R |
| 2,722,258 | 11/1955 | Smidt et al. | 150/1.5 R |
| 3,358,725 | 12/1967 | Bussard et al. | 220/73 |
| 3,422,978 | 1/1969 | Quackenbush | 215/216 |
| 3,628,709 | 12/1971 | Clifton | 220/23.4 |
| 3,633,786 | 1/1972 | Leedy | 220/23.2 |
| 3,815,281 | 6/1974 | Kander | 220/23.4 |

FOREIGN PATENTS OR APPLICATIONS

| | | | |
|---|---|---|---|
| 542,656 | 1/1932 | Germany | 220/23.4 |
| 633,122 | 2/1962 | Italy | 220/23.6 |
| 850,385 | 10/1960 | United Kingdom | 220/DIG. 19 |
| 207,317 | 11/1923 | United Kingdom | 150/1.5 R |

*Primary Examiner*—William Price
*Assistant Examiner*—Joseph M. Moy
*Attorney, Agent, or Firm*—Sughrue, Rothwell, Mion, Zinn and Macpeak

[57] ABSTRACT

A plurality of elongated, thin wall, light weight synthetic resin, relatively fragile tubular golf club protector bodies are detachably interlinked by protector caps whose cylindrical bodies are composed of spaced coaxial cylindrical inner and outer walls closed at one end and defining an annular space between the walls of a radial dimension slightly less than the wall thickness of the golf club protector bodies, the cap bodies being forcibly pressed onto one end of the golf club protector bodies to mechanically reinforce the ends of the golf club protectors through which the golf club shafts are inserted and removed. Each cap body includes circumferentially spaced integral joint parts which are linked together either by an integral or separate joint member.

10 Claims, 9 Drawing Figures

DETACHABLY INTERLINKED REINFORCED TUBULAR GOLF CLUB PROTECTORS

BACKGROUND OF THE INVENTION

1. Field of the Invention

This invention relates to golf club protectors of the type comprising a plurality of thin wall, tubular elements positioned within a golf bag and forming an upstanding array, each protector tube carrying individually a golf club by way of inserting the golf club shaft within the protector, and more particularly, to caps mounted to the upper ends of the protector tubes for protecting the upper ends of the protector bodies and permitting the free connection of a plurality of the protector bodies together, but permitting the protector bodies to be freely released from each other.

DESCRIPTION OF THE PRIOR ART

It has heretofore generally been provided as a means to protect individual golf clubs by placing each of the golf clubs in thin, elongated, tubular protector bodies which tubular protector bodies are carried in an array in upstanding fashion within a golf bag, thus permitting the individual golf clubs to be removed from the bag and from a particular protector body by the smooth insertion and removal of the club from corresponding protector body, while at the same time preventing the clubs from being damaged during transport of the bag. However, conventionally known protector bodies have the deficiencies that they are relatively fragile and that when a club is removed from one of the protectors the adjacent protectors as well as the protector housing that particular club tends to be partially removed from the bag and the very act of insertion and removal of the club causes the upper ends of the protector bodies to become worn and damaged, and there is a tendency for the tubular protector bodies to be broken due to external shock imparted thereto during their transport.

In order to eliminate these defects, it has been proposed to provide caps having a plurality of openings which are joined to individual upper ends of a plurality of protector bodies. However, it is impossible to optionally connect a varying number of protector bodies with these kind of caps, since the number of bodies must correspond to the number of openings within the caps. Another proposal to eliminate the problems enumerated above involves the provision of a cap for each protector and an arrangement for linking the caps in series. The known arrangements are defective in that the joined caps are easily released after frequent and repeated insertion and removal of clubs and no true satisfactory caps and protector body combination has heretofore been obtained.

SUMMARY OF THE INVENTION

This invention overcomes the above mentioned defects in conventionally known devices of this kind and one object thereof is to provide an improved cap and protector body combination in which mutually connected caps are not easily released even after frequent and repeated insertion and removal of clubs.

Another object of this invention is to provide such a cap and protector body combination that effectively prevents the wearing of the upper end of the protector body to which the cap is applied and an arrangement in which adjacent protectors are not lifted together when a single club is being removed from one of the protector bodies.

Still another object of this invention is to provide an effective cap and protector combination in which an optional number of caps and protector bodies may be linked together.

Other objects and features of this invention will become more apparent from the detailed description of the preferred embodiments of the invention with reference to the accompanying drawings.

DETAILED DESCRIPTION OF PREFERRED EMBODIMENTS

Figure 1:
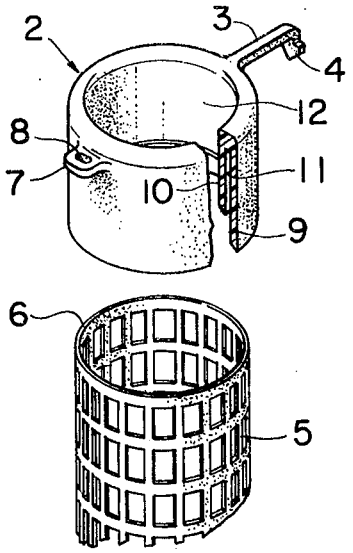
FIG. 1 is an exploded perspective view, partially broken away, of the improved cap and protector body combination of the present invention.
Figure 2:
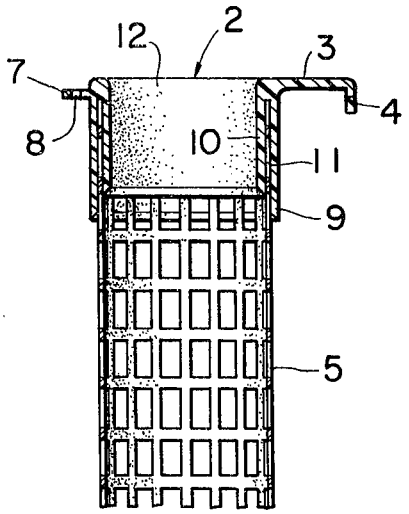
FIG. 2 is a sectional view of the embodiment of the invention of FIG. 1.
Figure 3:
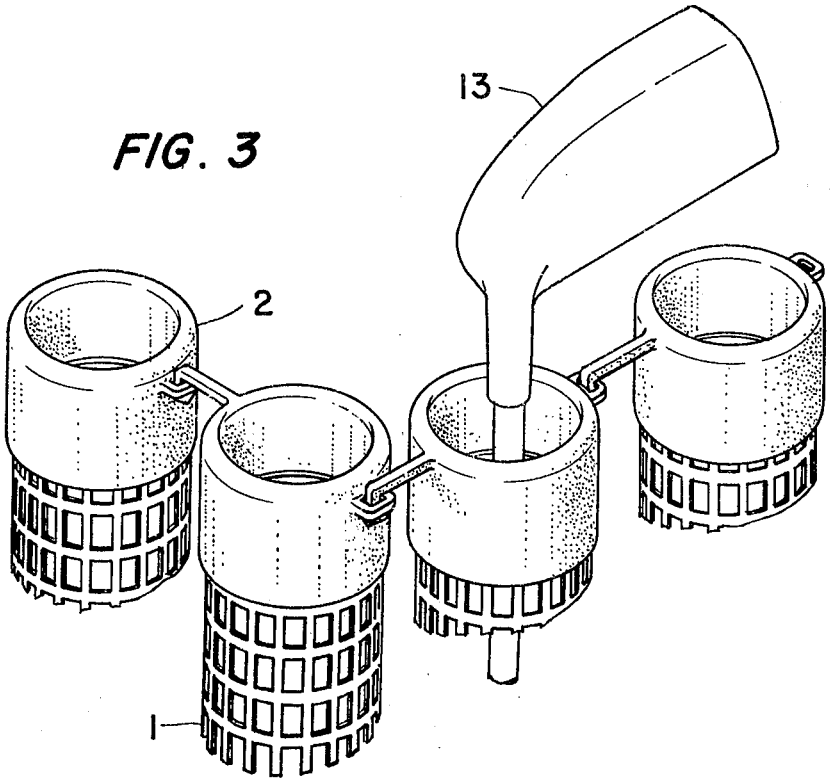
FIG. 3 is a perspective view of a plurality of protectors of the type illustrated in FIGS. 1 and 2.

With respect to FIGS. 1, 2 and 3, a cylindrical cap body 2 if formed of synthetic resin, rubber or like material and is provided with a central opening 12 which receives a golf club therein during use, as seen in FIG. 3. The cap body is composed of an outer wall 9 and an inner wall 10 disposed in parallel to each other, that is, the walls 9 and 10 are coaxial and spaced radially from each other to form an annular space 11 therebetween. Both the inner and outer walls 9 and 10 are joined at one end thereof, and thus one end of the annular space 11 is blocked and the other end is open. The open end of said annular space permits the cap body 2 to receive the upper end 6 of a golf club protector body 5 to form a golf club protector 1, the width of said annular space 11 in the direction of its radius is formed somewhat narrower than the thickness of the protector body 5 to be joined thereto, this being preferable such that the cap must be mounted to the protector body under pressure.

The protector body 5 is in the form of an elongated tube or cylinder formed of synthetic resin such as a polyolefin copolymer such as polyethylene, propylene, EVA (ethylene-vinyl-acetate copolymer) etc. It is relatively fragile with the annular rim at the upper end 6 of the golf club protector body 5 being incapable of receiving the sustained shock caused by insertion and removal of the golf clubs such as club 13 for each protector, FIG. 3. Further, the protector body 5 which is, for example, of a length of 850 mm and having an outer diameter of 34 mm and an inner diameter of 31 mm, therefore provided with a thickness on the order of 1.5 mm, and further, the protector body 5 is formed of an open latticework to further lighten and economically form the synthetic resin protector body which adds little weight to the golf bag which must be carried by the golfer, thus weight is important even though the weight of the golf club protectors 1 is substantially less than the golf clubs carried thereby. Although the various embodiments of the invention are shown in terms of an open meshwork or latticework formed of synthetic resin golf protector bodies 5, the bodies may be formed of solid wall tubular members, although it is preferred that the cylindrical or tubular members 5 are of latticework construction to greatly reduce the amount of synthetic resin forming the same and therefore the cost.

Integrally formed within the cap bodies 2 at circumferentially displaced positions are projecting joint parts 3 and 7, the projecting joint part 7 being provided with a slit or narrow slot 8 while joint part 3 has its terminal end bent downward defining a laterally expanded protuberant part 4 of such shape as to taper, that is, its end is gradually thinned (in the drawing, this is shown as taking the configuration of a heart). The joint parts being circumferentially spaced 180°, that is directed oppositely from each other, however, the positions may be varied.

The above described expanded protuberant part 4 is formed in the drawing, FIG. 1, in the form of a heart. However, this may take other forms such as spherical form or the like. In any case, when one of the expanded protuberant parts is inserted into one of the slits or slots of a projecting joint part of another cap with the insertion being achieved under pressure while expanding the slit or slot, after the two joint parts are connected the expanded protuberant part is well engaged within the slit and not easily released therefrom. In order to effect the cap and protector body combination, a protector in the form of the improvement of the present invention consists of the above mentioned elements joined under pressure with the upper end 6 of the club protector body being inserted under pressure within the annular space 11 of the cap body 2 as shown in FIG. 2. Preferably, during the insertion of the upper end 6 of the club protector body within the annular space 11 of the cap body 2, an adhesive is employed to insure the fixing of one element to the other, alternatively thermal welding or a like operation may be employed.

Further, as shown in FIGS. 1 and 2, when the outer wall 9 is formed somewhat longer than the inner wall 10, the insertion of the upper end of the protector body 5 into the cap is facilitated.

The above explanation covers the main purpose, usage and functional construction of the improved cap and protector body combination of the present invention and shows that is is possible to link in series an optional number of club protectors 1 by placing the caps on the club protector bodies and then inserting under pressure the expanded protuberant part 4 of the terminal end of the joint part 3 of one cap within a slit 8 of the projecting joint part 7 of an adjacent cap.

Figure 4:
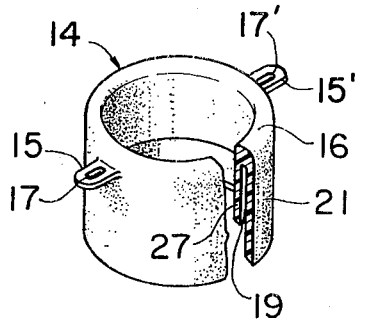
FIG. 4 is a perspective view, partially broken away, of a cap of yet another embodiment of the present invention.

Reference to FIG. 4 shows an alternate embodiment of the present invention. In this case, the cap 14 is applied to a protector body 18, FIG. 6, the protector body 18 being provided with openings as at 20 formed of a meshwork, the cap 14 and the protector body 18 being formed of identical material and in the same manner as the cap bodies and protector bodies of the prior described embodiment. The cap takes the form of a cylindrical cap body consisting of coaxial outer inner walls 21 and 27 respectively defining an annular space 19 therebetween for receiving the club protector body 18 and having dimensions and configuration identical to that of the embodiment of FIG. 1. One end of the cap is closed and the other open with the annular space 19 open only at its lower end into which the upper end of the club protector body 18 is inserted. The difference here is that on the outer wall of the cap body there are provided joint parts 15 and 15', each having slots or slits as at 17 and 17' respectively, preferably at diametrically opposite positions, the parts being integral with the cap body.

The cap 14 is made of an elastic and tough material such as synthetic resin, rubber and the like analogous to the embodiment of FIG. 1.

Figure 5:
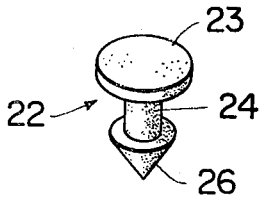
FIG. 5 is an enlarged perspective view of a joint member employed in the embodiment of the invention of FIGS. 4 and 6.

This embodiment further includes a separate joint member 22 as shown in FIG. 5. The joint member 22 consists of a small diameter cylindrical part 24, a disc part 23 at one end integrally formed with the small diameter cylindrical part 24 and a circular cone part 26 having an enlarged diameter base larger than the diameter of the cylindrical part 24 and integrally formed at the other end of the part 24. The width of each of the slits or slots 17 and 17' of joint parts 15 and 15' respectively is narrower than the diameter of the disc part and the circular cone part with the diameter of the part 24 determined so that that part is freely movable within the slots.

Figure 6:
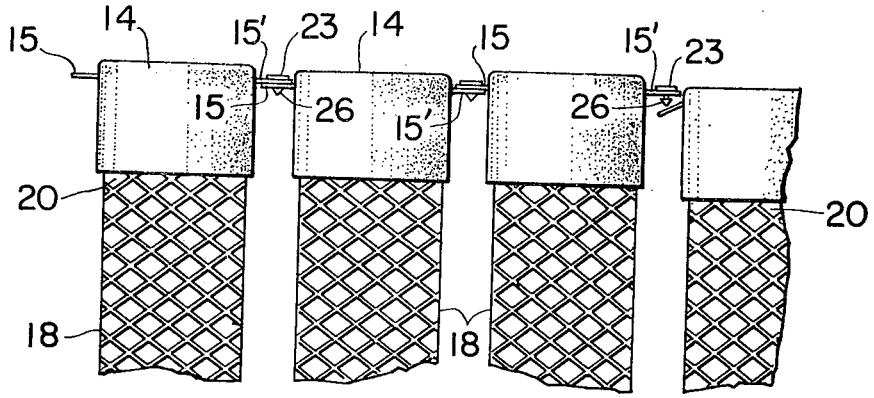
FIG. 6 is side elevational view of a portion of a plurality of golf club protectors incorporating the cap and joint member of FIGS. 4 and 5 respectively.

In this embodiment, the cap 14 is pressure mounted to the upper end of a protector body 18, and then after the two are optionally assembled by way of an adhesive, the incorporated caps of a plurality of protectors are positioned such that a slot 17 of one joint part 15 of one cap 14 overlies the slot 17' of the joint part 15' of an adjacent cap, and thereafter the joint member 22 is inserted into the superposed slots by pushing the sharp end of the circular cone part 26 and by utilizing the elasticity of the joint parts 15 and 15', whereby the small diameter cylindrical part 24 of the joint member 22 is received by the superposed slots to link the two protectors to each other. As seen in FIG. 6, an optional number of the protectors may be freely linked together.

Figure 7A:
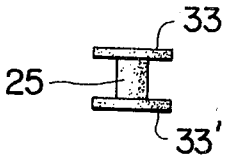
FIGS. 7A, 7B, and 7C are enlarged views of various joint members forming alternate embodiments of the present invention.
Figure 7B:
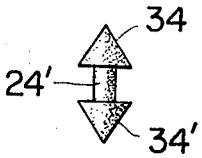
Figure 7C:
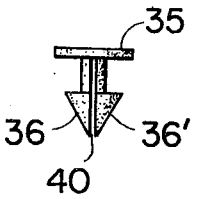

The separate joint member may have a different shape from that shown in FIG. 5, for example, as shown in FIG. 7A, FIG. 7B, and FIG. 7C, the joint parts have different configurations. In the embodiment of FIG. 7A, these parts 33 and 33' are integrally formed at respective ends of a small diameter cylindrical part 25; in the embodiment of FIG. 7B, oppositely directed circular cone parts 34 and 34' are formed on respective ends of a small diameter part 24'; and in FIG. 7C, a groove 40 is axially formed within a portion of the joint member extending from the tip end of the circular cone part which is the form that the expanded protuberant part takes, this axial slot or groove 40 provides the expanded protuberant part into portions 36 and 36' providing a higher elasticity so that the member may be easily inserted into aligned slots 17 and 17' in the manner of the illustrated embodiment of FIG. 6.

The joint members may be made of the same elastic material as the cap body or may be made of other rigid material.

What is claimed is:

1. A plurality of separately detachable golf club protectors for positioning within a golf bag in upright, side-by-side fashion, with each golf club protector housing a single golf club; each golf club protector comprising a cap and a golf club protector body, said golf club body comprising an elongated, thin wall, light weight, synthetic resin cylinder of a diameter slightly larger than the diameter of the shaft of the golf club insertably carried therein, said cap including a cap body of an elastic material and being composed of spaced, coaxial cylindrical inner and outer walls, one end of said cap body being blocked to form a one end open annular space therebetween, each golf club protector body being of a thickness greater than the radial width of the annular space and having one end forcibly insertably received within said annular space of said cap body such that the inner and outer walls of said cap body embrace the end of the cylindrical golf club protector body to mechanically reinforce the same and protect the golf club protector body from damage during insertion and removal of its golf club, each cap body including joint parts projecting radially from said outer wall at circumferentially disposed positions and being integral therewith, and a joint member detachably interengagably linking said joint part of one of said protector cap bodies to a joint part of another protector cap body.

2. The golf club protectors as claimed in claim 1, wherein said joint parts extend in diametrically opposite directions, one of said joint parts is provided with a slit and said joint member comprises an expanded protuberant part integral with and at the radially outer end of said other joint part, and interfittingly inserted within a slit of another joint part of an adjacent golf club protector.

3. The golf club protectors as claimed in claim 2, wherein said expanded protuberant part is in the form of a heart having a taper in the direction of the end at the end of said joint part and being bent at right angles parallel to the direction of the axis of said cap body.

4. The golf club protectors as claimed in claim 2, wherein said expanded protuberant part is of circular configuration.

5. The golf club protectors as claimed in claim 1, wherein the length of the inner wall of said cap body in the direction of its axis is shorter than that of the outer wall.

6. The golf club protectors as claimed in claim 1, wherein said joint parts are two in number for each cap body, each joint part having a slit and being positioned at diametrically opposite sides of said cap body, and wherein said joint member detachably interengagably linking said joint parts comprises a separate element having expanded protuberant parts on both ends thereof and joined by a reduced diameter portion with one expanded protuberant part being pressed into aligned slits of overlapping projecting joint parts of adjacent protectors.

7. The golf club protectors as claimed in claim 6, wherein each joint member is composed of a central cylindrical part of reduced diameter, and of a disc part and a circular cone part of enlarged diameter formed on opposide ends thereof.

8. The golf club protectors as claimed in claim 6, wherein each joint member is composed of a central, small diameter cylindrical part and a pair of enlarged diameter disc parts formed on respective ends thereof.

9. The golf club protectors as claimed in claim 6, wherein each joint member is composed of central, small diameter cylindrical part and circular cone parts formed on respective ends thereof having diameters in excess of that of the central part.

10. The golf club protectors as claimed in claim 6, wherein a slot is formed in each joint member from one end thereof towards the other end in the direction of the axis thereof to split said expanded protuberant part into two sections.

* * * * *